US012589426B2

(12) United States Patent
Nillies

(10) Patent No.: US 12,589,426 B2
(45) Date of Patent: Mar. 31, 2026

(54) FLOW-FORMING MACHINE AND METHOD FOR FLOW-FORMING

(71) Applicant: LEIFELD METAL SPINNING GMBH, Ahlen (DE)

(72) Inventor: Benedikt Nillies, Ahlen (DE)

(73) Assignee: LEIFELD METAL SPINNING GMBH, Ahlen (DE)

( * ) Notice: Subject to any disclaimer, the term of this patent is extended or adjusted under 35 U.S.C. 154(b) by 430 days.

(21) Appl. No.: 18/548,838

(22) PCT Filed: Feb. 10, 2022

(86) PCT No.: PCT/EP2022/053236

§ 371 (c)(1),
(2) Date: Sep. 1, 2023

(87) PCT Pub. No.: WO2022/184400

PCT Pub. Date: Sep. 9, 2022

(65) Prior Publication Data

US 2024/0173763 A1 May 30, 2024

(30) Foreign Application Priority Data

Mar. 2, 2021 (DE) ..... 20 2021 101 035.5

(51) Int. Cl.
*B21D 53/30* (2006.01)
*B21D 22/14* (2006.01)

(52) U.S. Cl.
CPC ..... *B21D 53/30* (2013.01); *B21D 22/14* (2013.01)

(58) Field of Classification Search
CPC ..... B21D 22/14; B21D 22/18; B21D 53/26; B21D 53/30; B23B 2215/08
See application file for complete search history.

(56) References Cited

U.S. PATENT DOCUMENTS

2007/0273108 A1* 11/2007 Kitatsuru ..... B23B 31/185 279/106
2019/0374991 A1 12/2019 Nillies

FOREIGN PATENT DOCUMENTS

EP 3 351 313 A1 7/2018
JP 2005-081449 A 3/2005
(Continued)

OTHER PUBLICATIONS

Translation of WO-2023284989.*
(Continued)

*Primary Examiner* — Bobby Yeonjin Kim
(74) *Attorney, Agent, or Firm* — Studebaker Brackett PLLC

(57) ABSTRACT

The invention relates to a flow-forming machine and a method for flow-forming a substantially rotation-symmetric workpiece having a drum-shaped circumferential portion, comprising a spindle which can be driven in rotation about a spindle axis, a clamping device which is arranged on the spindle and has a plurality of clamping elements which are adjustable between a clamping position, in which the clamping elements abut against an outer circumferential region of the workpiece with a predetermined clamping force and hold the workpiece on the spindle for forming, and a release position in which the clamping elements are spaced from the workpiece in a defined manner for releasing the workpiece from the spindle, by means of a first actuating device, wherein the clamping force for holding the workpiece on the spindle during forming can be applied by the first actuating device, and a plurality of forming rollers which are radially and axially feedable to the drum-shaped circumferential portion for forming the circumferential portion of the workpiece. According to the invention, it is provided that a second actuating device is provided on the clamping device, by means of which a position of the clamping elements can
(Continued)

Figure 1:
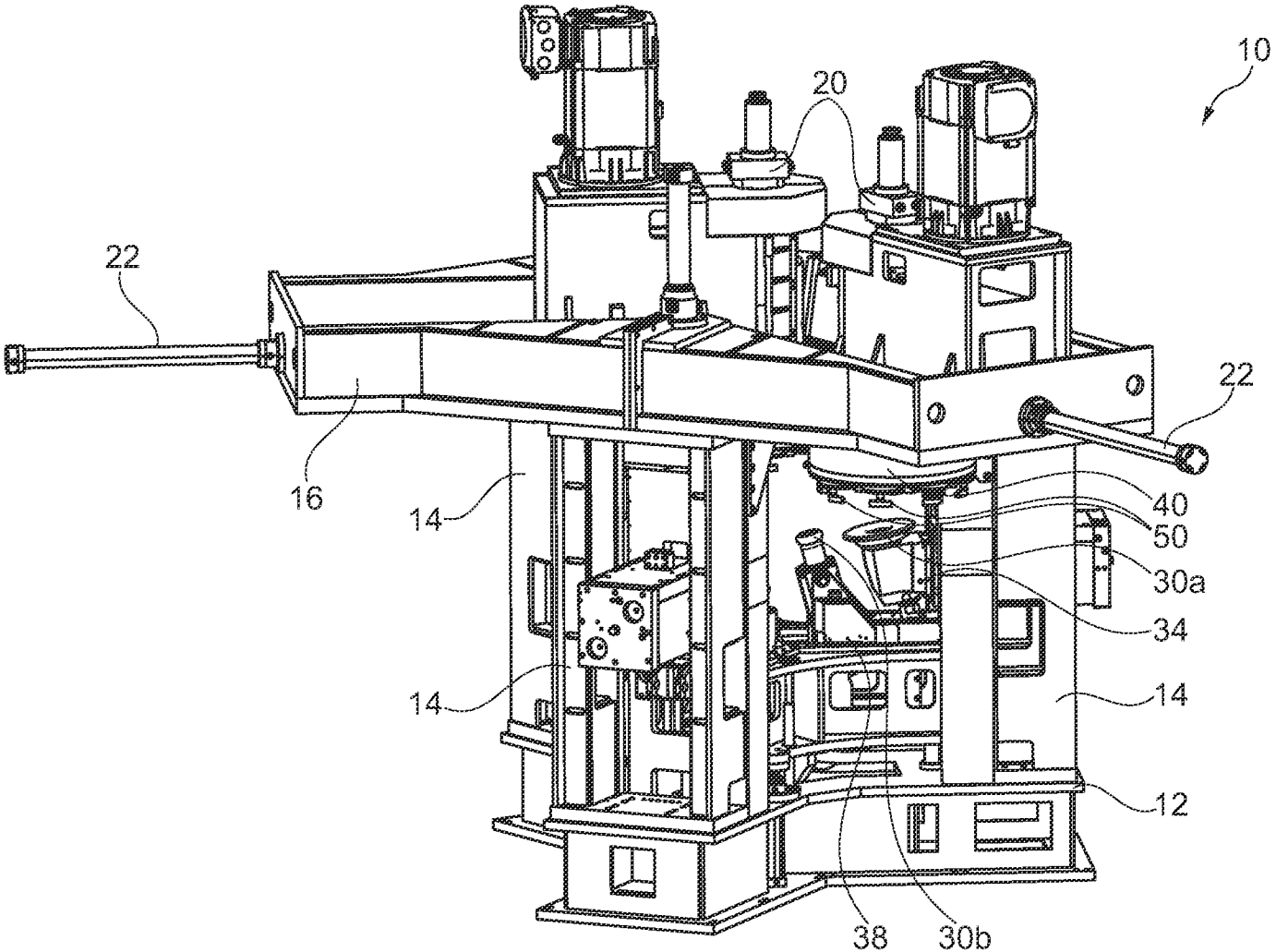

be set in a radial direction for adapting to a diameter of the workpiece, and that a control device is provided, by means of which the second actuating device can be actuated depending on the diameter of the workpiece to be formed, wherein the clamping elements are radially pre-positioned depending on the diameter of the workpiece.

18 Claims, 6 Drawing Sheets

(56) References Cited

FOREIGN PATENT DOCUMENTS

| | | | | | |
|---|---|---|---|---|---|
| KR | 102281547 | B1 * | 7/2021 | ..... | B21D 53/30 |
| WO | 2007/140257 | A2 | 12/2007 | | |
| WO | 2018/133959 | A1 | 7/2018 | | |
| WO | 2019/185239 | A1 | 10/2019 | | |
| WO | WO-2023284989 | A1 * | 1/2023 | ..... | B21D 22/16 |

OTHER PUBLICATIONS

Translation of KR-102281547.*
International Search Report issued in PCT/EP2022/053236; mailed May 18, 2022.
International Preliminary Report on Patentability and Written Opinion issued in PCT/EP2022/053236 on Aug. 29, 2023.

* cited by examiner

FLOW-FORMING MACHINE AND METHOD FOR FLOW-FORMING

The invention relates to a flow-forming machine for flow-forming a substantially rotation-symmetric workpiece with a drum-shaped circumferential portion, having a spindle which can be driven in rotation about a spindle axis, a clamping device which is arranged on the spindle and has a plurality of clamping elements which are adjustable between a clamping position, in which the clamping elements abut against an outer circumferential region of the workpiece with a predetermined clamping force and hold the workpiece on the spindle for forming, and a release position, in which the clamping elements are spaced from the workpiece in a defined manner for releasing the workpiece from the spindle, by means of a first actuating device, wherein the clamping force for holding the workpiece on the spindle during forming can be applied by the first actuating device, and a plurality of forming rollers which are radially and axially feedable to the drum-shaped circumferential portion for forming the circumferential portion of the workpiece, according to the preamble of claim 1.

The invention further relates to a method for flow-forming according to the preamble of claim 18.

During flow-forming of a workpiece, in particular for the manufacture of a vehicle wheel, a disk-shaped or pot-shaped workpiece is set into rotation, wherein a drum-shaped wall area is formed by changing the wall thickness of the starting workpiece. During this action, very high circumferential forces occur on the workpiece in the axial and circumferential direction. To reliably hold the workpiece rotary driven on a spindle in a fixed manner on a spindle, a clamping device must be provided on the drive spindle which can exert sufficiently high clamping forces on the workpiece. The processing forces occurring on a flow-forming machine can be many times higher than the processing forces that can occur, for example, on a lathe for material machining.

In flow-forming, in order to apply the necessary clamping forces to hold the workpiece in the exact position on the spindle, it is usually known to press the workpiece axially against the spindle by means of a counterholder. In this case, high axial clamping forces can be applied by axially acting hydraulic cylinders.

However, when a workpiece is clamped axially on a flow-forming machine by means of a counterholder, an interior space within the drum-shaped workpiece wall to be formed is completely or at least partially occupied. This means that the occupied interior space is no longer available as a process space.

EP 3 351 313 A1 describes a flow-forming machine of the generic type, in which an inner space for the feeding of interior forming rollers is required for forming a vehicle wheel. Overall, a flow-forming machine is described in which a drum-shaped workpiece area is formed between at least one inner roller and at least one associated outer roller. For clamping the workpiece, a clamping device with outer clamping claws is provided, by means of which the workpiece is held at a radial outer edge during flow-forming. The clamping claws have a linear displacement path and an actuating device by means of which the clamping claws are adjustable between a release position and the clamping position for holding the workpiece. The actuating device causes an adjustment of the clamping claws and applies the necessary clamping force to the workpiece to hold it on the spindle.

With clamping devices of this type, the clamping travels must be set as small as possible to ensure efficient clamping at the desired high clamping force. If changes occur, especially in the outer diameter of a workpiece, the clamping device must be readjusted with the corresponding feed and clamping paths.

The object underlying the invention is to provide a flow-forming machine and a method for flow-forming a workpiece, which allow for a particularly efficient processing of the workpieces.

According to the invention, the object is achieved on the one hand by a device having the features of claim 1 and on the other hand by a method having the features of claim 18. Preferred embodiments of the invention are indicated in the dependent claims. The invention further comprises in principle a method for flow-forming a workpiece using such a flow-forming machine.

The flow-forming machine according to the invention is characterized in that a second actuating device is provided on the clamping device, by means of which a position of the clamping elements can be set in a radial direction for adapting to a diameter of the workpiece, and in that a control device is provided, by means of which the second actuating device can be actuated depending on the diameter of the workpiece to be formed, wherein the clamping elements are radially pre-positioned depending on the workpiece diameter.

A basic idea of the invention is to provide a flow-forming machine having a clamping device, which has a first actuating device for adjusting the clamping elements, wherein the first actuating device always ensures an identical or substantially identical adjustment path for the clamping elements, so that a desired clamping force is achieved by the first actuating device after an intended adjustment path of the clamping elements. In addition, the clamping device of the flow-forming machine according to the invention has a second actuating device by means of which a pre-positioning of the clamping elements in the radial direction can be set for adapting to a diameter of the workpiece. This pre-positioning is controlled automatically by a control device, which actuates the second actuating device on the basis of information about the workpiece to be processed and in particular the diameter of the workpiece to be formed, and thus prepares a suitable pre-positioning of the clamping elements for the actual clamping movement by the first actuating device.

The invention not only ensures particularly good clamping on the outer side of the workpiece, so that flow-forming of a workpiece can be carried out reliably even with high forming forces. Pre-positioning can also shorten the time period required for the actual clamping of a workpiece, thus reducing the proportion of nonproductive time during the processing of a workpiece. This improves machine utilization and reduces costs.

In addition, an advantage of the invention is that a high degree of processing flexibility can be achieved by automatic pre-positioning of the clamping elements by the second actuating device via the control device. Thus, a large number of workpieces with different diameters can be efficiently flow-formed in an almost arbitrary order without time-consuming modifications to a clamping device. Preferably, the second actuating device is only actuated when there is a change in the type of workpiece, i.e. when workpieces of different starting dimensions and diameters are to be processed.

A preferred embodiment of the invention is that the clamping elements are axially and/or radially adjustable between the clamping position and the release position by the first actuating device. In particular, the clamping elements are first radially and then axially fed by the first actuating device, wherein the actual clamping force is effected exclusively or to a large extent by the axial movement of the clamping elements. This allows the workpiece to be pressed against the spindle with particular reliability and held thereon.

In principle, the actuating device can be configured in an arbitrary manner, for example by a recirculating ball screw. According to a further development of the invention, particularly high actuating forces can be achieved in that the first actuating device has at least one actuating cylinder, which is preferably hydraulically operated. The actuating cylinder can generate the necessary clamping force on its own or in combination with at least one further force-generating element, such as a disk spring assembly.

A further increase in the overall clamping forces can be achieved in that an actuating cylinder is assigned to each clamping element, by means of which the adjusting element is displaceable between the clamping position and the release position. In the release position, the clamping elements are in each case spaced so far from the workpiece so that it can be removed from the spindle and a new workpiece can be inserted.

In principle, the individual clamping elements can be provided on displaceable carriages for pre-positioning. According to a further development of the invention, it is particularly expedient that each clamping element is mounted on a rotatable disk eccentrically to a disk axis, wherein the disk axes are oriented parallel to the spindle axis, and that the second actuating device comprises an actuator for twisting the disks with the clamping elements. In principle, an actuator for twisting can be assigned to each rotatable disk. It is particularly advantageous that a single actuator, in particular an adjusting wheel, is provided for twisting all the disks. This can be controlled and actuated via a corresponding drive pinion of the second actuating device. In principle, the flow-forming machine can be provided with a horizontally oriented spindle axis.

Alternatively, according to one embodiment of the invention, it is preferred that here the clamping element is mounted on a radially displaceable or pivotable carriage and the second actuating device is configured for radially displacing or pivoting the carriage. An actuating cylinder for displacing and clamping the respective clamping element can also be arranged on the carriage.

According to a further development of the invention, a particularly compact design is achieved in that the spindle axis is arranged vertically and that the clamping device is arranged suspended to the spindle, wherein a workpiece can be clamped from below. Such a vertical suspension of the workpiece facilitates, in particular a removal of the workpiece by an automatic loading and unloading device, in particular a manipulator arm and/or robot. When the clamping device is released, the workpiece can then be removed downwards in a simple manner, preferably by the same manipulator and/or robot.

According to a further preferred embodiment of the invention, it is advantageous that at least one discharge opening is provided and that an suction device is provided by means of which air and/or fume can be sucked off through the at least one discharge opening. Preferably, the discharge opening can be provided in the area of the clamping device, in particular in the case of a suspended arrangement. Via the one or more discharge openings, in particular vapor with components of oil or coolant can be efficiently removed from the working chamber and supplied to a separating device and/or a recycling device for recovering cooling and lubricating fluid.

According to one embodiment of the invention, a further improvement in processing is achieved in that a central centering pin is arranged on the clamping device, which is preferably configured to be resiliently and/or flexibly centering, so that workpieces with different bore diameters can be centered reliably and precisely. This enables reliable and at the same time gentle centering of the workpiece on the spindle before or during clamping.

According to one embodiment variant of the invention, a particularly efficient processing flow is achieved in that the control device for supplying data concerning the workpiece, in particular data concerning the diameter of the workpiece, is connected to a control station and/or at least one sensor for detecting the workpiece using the diameter. Via a central control station, the flow-forming machine can always be supplied with information on the type of workpiece that is currently to be processed. In the case of chaotic production with a large number of possible pre-processing stations, the type of workpiece, in particular a diameter, can be detected by at least one sensor which is connected to the control device. Depending on the data supplied, the second actuating device for pre-positioning the clamping elements can be actuated via the control device if necessary.

Furthermore, it is advantageous that for flexible forming of each individual workpiece, the control device controls a movement of the forming rollers during forming. Depending on the type of workpiece to be processed, the forming rollers can thus be displaced in a defined manner by the control device in order to shape a desired wall thickness profile and a desired workpiece contour. With the flow-forming machine according to the invention, flexible and efficient production of even small quantities or even individual workpieces can be achieved in this manner.

A particularly high degree of flexibility is achieved, in particular according to a further development of the flow-forming machine according to the invention, in that at least one outer forming roller and at least one inner forming roller are provided, which abut against an outer circumference and an inner circumference, respectively, of the drum-shaped circumferential wall portion of the workpiece and which, for forming and shaping a wall thickness profile with changing wall thickness, are adjustable relative to one another in the axial and radial direction by the control device and/or a pitch angle of the at least one inner forming roller is variable. In this way, an individual contour and wall thickness profile can be produced for almost every individual workpiece with the same efficiency as in mass production.

Another preferred embodiment of the invention resides in the fact that two interchangeable spindles are provided, wherein a first interchangeable spindle is located in the working chamber, whereas a second interchangeable spindle is located in a loading and/or unloading position, wherein the two interchangeable spindles are movable alternately relative to one another. The two interchangeable spindles may be displaceable in a reversing manner, with the two interchangeable spindles alternately assuming the working position in the working chamber and one of the two loading and/or unloading positions for loading or unloading the workpiece. For example, a turret mechanism may be provided. The individual interchangeable spindles can also have different loading and unloading positions from one another, wherein the respective interchangeable spindle is then displaced from these positions into the respective working chamber. This enables fast loading and/or unloading and therefore a faster overall processing time.

According to a further development of the invention, it is advantageous that a measuring device is arranged by means of which process-relevant dimensions and data of the workpiece can be identified prior to and/or after forming. The measuring device can in particular have an optical and/or thermal sensor for identifying the workpiece. The measuring device communicates, in particular with the control device.

In principle, the flow-forming machine is designed for a cold forming method. For certain processes, it can be advantageous to provide at least one cooling device and/or one heat-protective device for semi-hot and/or hot forming of the workpiece. In particular, for the shaping of light metal wheels, a targeted temperature control of the workpiece can be achieved and adjusted in this way. In hot forming, the workpiece blank temperature can also be measured by means of a pyrometer or a temperature sensor before the workpiece blank is introduced into the working area of the flow-forming machine.

Preferably, the rollers of the inner and outer support are configured as standard universal rollers on the flow-forming machine. However, particular wheel geometries or wheel hub geometries may require a roller change. A further improvement with regard to the flexibility of the flow-forming machine according to the invention can be achieved in that a quick-release clamping device is arranged on an inner support and/or an outer support on at least one bearing of an outer forming roller and/or at least one inner forming roller, by means of which a semi-automatic or fully automatic roller change can be carried out. The roll geometry can be efficiently adapted to a corresponding contour course of a specific workpiece. This still further increases the variety of shapes of workpieces that can be achieved with a flow-forming machine.

For targeted temperature control during forming, it can also be useful for the workpiece to have a temperature in a forming area that differs from that in a clamping and/or centering area. Preferably, the area of the spokes has a lower temperature than the forming area. In particular, an increased temperature can be provided in the forming or working area of the workpiece on which the forming rollers engage.

The invention further comprises a method for flow-forming a substantially rotation-symmetric workpiece having a drum-shaped circumferential portion, in particular with one of the flow-forming machines described above, wherein the workpiece is clamped to a spindle by means of a clamping device, wherein the clamping device has a plurality of clamping elements which are adjusted between a clamping position, in which the clamping elements abut against an outer circumferential region of the workpiece with a predetermined clamping force and hold the workpiece on the spindle for forming, and a release position in which the clamping elements are spaced from the workpiece in a defined manner for releasing the workpiece from the spindle, by means of a first actuating device, wherein the clamping force for holding the workpiece on the spindle during forming is applied by the first actuating device, the spindle is rotationally driven about a spindle axis, and a plurality of forming rollers are radially and axially fed to the workpiece for forming the circumferential wall portion, wherein the method is characterized in that a second actuating device is provided on the clamping device, by means of which a position of the clamping elements is adapted to a diameter of the workpiece and the clamping elements are adjusted in a radial direction, and in that a control device is provided by means of which the second actuating device is actuated depending on the diameter of the workpiece to be formed, so that the clamping elements are radially pre-positioned depending on the workpiece diameter.

A particularly energy-efficient flow-forming machine has the option of recuperation when braking at least one main spindle having a chuck. Despite the lightweight design of the chuck, considerable masses have to be accelerated or decelerated. Preferably, the recuperated energy of the first interchangeable spindle is used to accelerate the second interchangeable spindle and/or a Flywheel masses energy storage. Alternatively, energy recuperation with net regenerative feedback is also possible.

In order to make the availability of the flow-forming machine particularly high, the machine with two interchangeable spindles can also be operated economically as a single-spindle machine. In the event of low capacity utilization, lack of raw material, maintenance or malfunctions on an interchangeable spindle and/or upstream and/or downstream line or system malfunctions, the flow-forming machine can continue to be operated with only one spindle.

Figure 2:
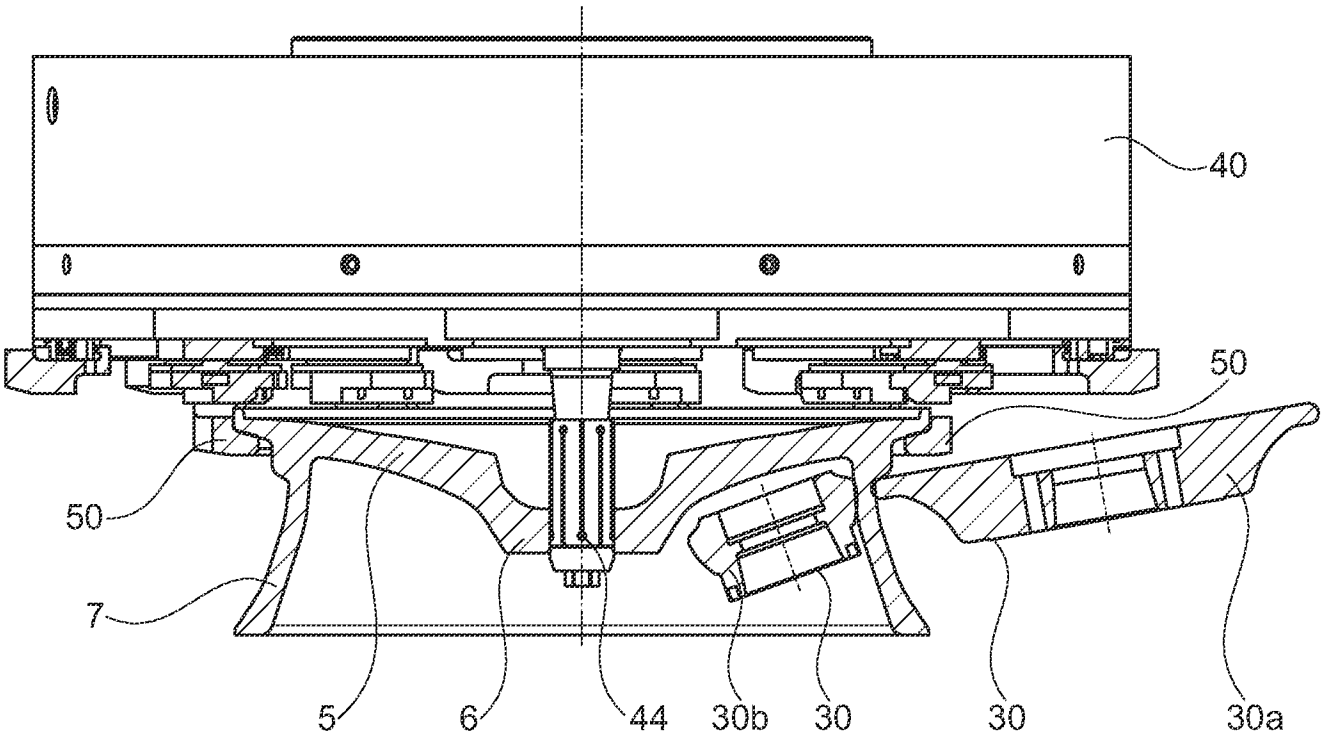
Figure 3:
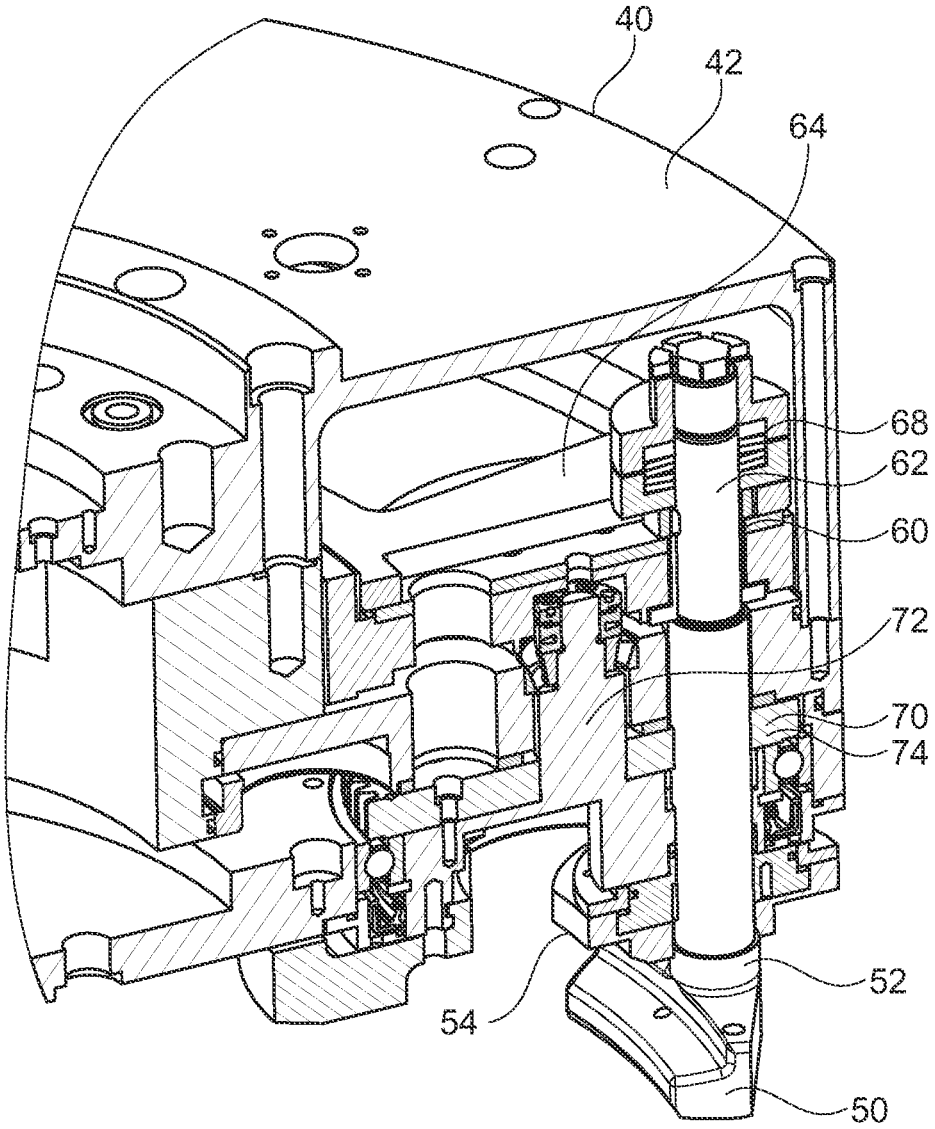
Figure 4:
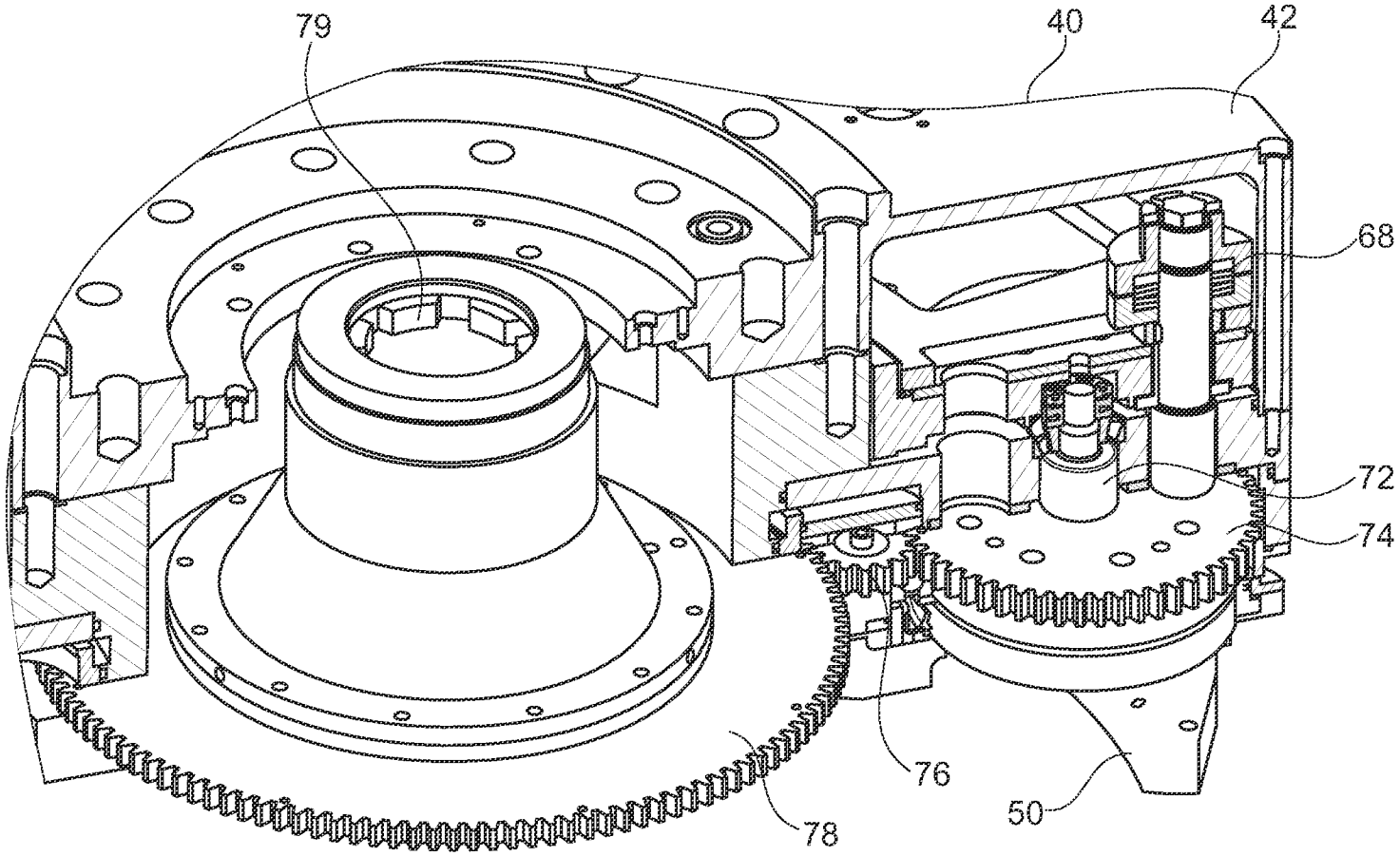
Figure 5:
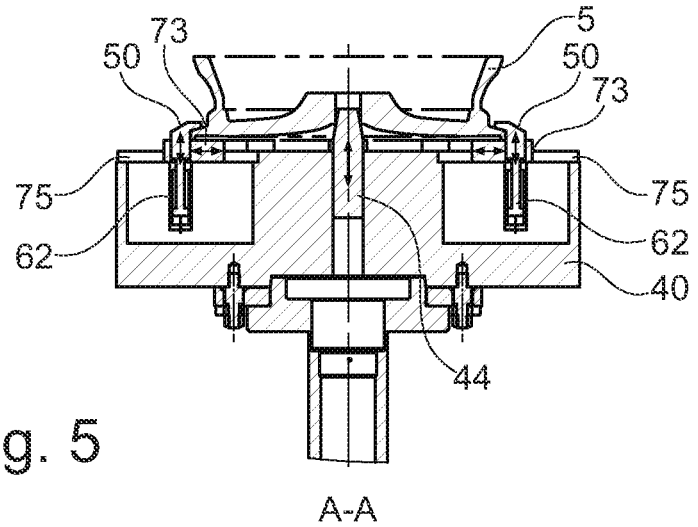
Figure 6:
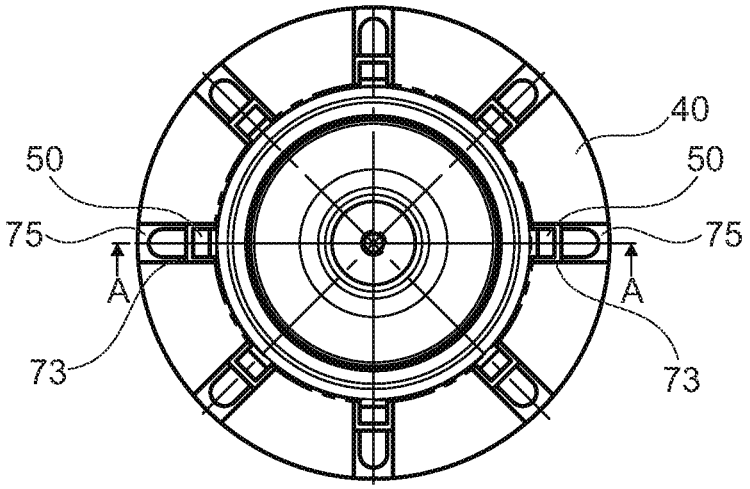
Figure 7:
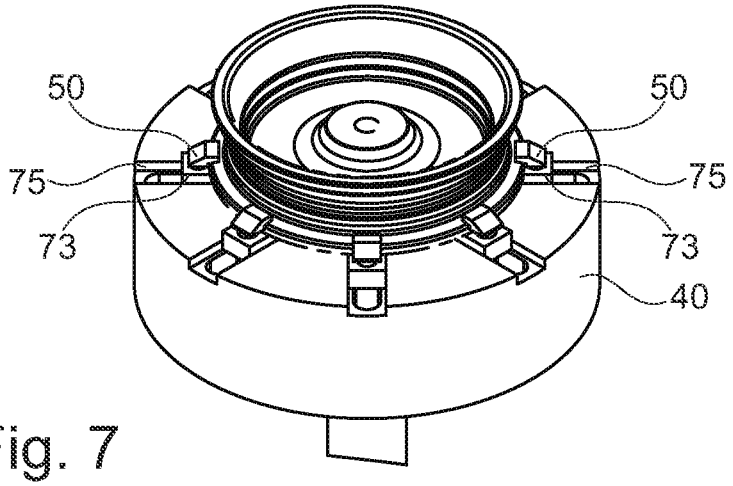
Figure 8:
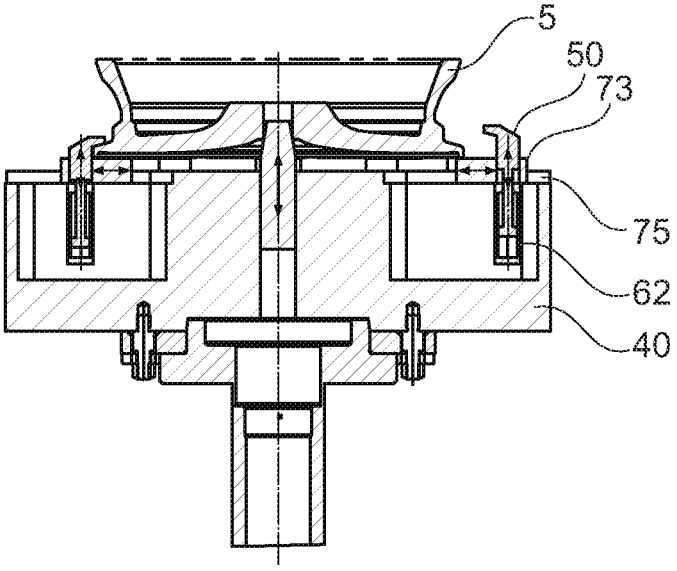
Figure 9:
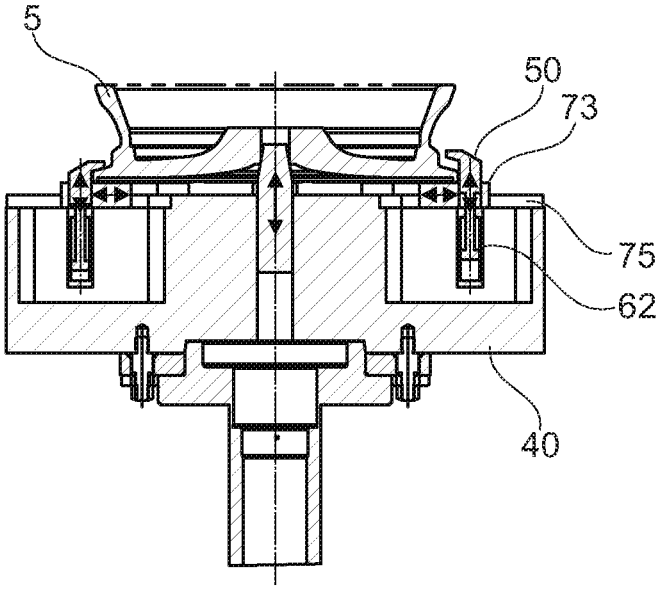

The invention is explained in more detail below with reference to preferred exemplary embodiments, which are shown schematically in the drawings. The drawings show in:

FIG. 1 a perspective view of a flow-forming machine according to the invention without protective housing and loading and unloading device;

FIG. 2 an enlarged view of the clamping device of the flow-forming machine according to the invention with a clamped workpiece in cross-section;

FIG. 3 an enlarged, partially sectional, detailed perspective view of the clamping device according to FIG. 2;

FIG. 4 another enlarged, partially sectional, detailed perspective view of the adjustment mechanism for the clamping device according to FIGS. 2 and 3;

FIG. 5 a cross-sectional view of an alternative clamping device for a flow-forming machine according to the invention;

FIG. 6 a top view of the clamping device of FIG. 5;

FIG. 7 a perspective view of the clamping device according to FIGS. 5 and 6;

FIG. 8 another cross-sectional view of the clamping device according to FIGS. 5 to 7, with the clamping element shown in the right half in the release position; and FIG. 9 another cross-sectional view of the clamping device according to FIGS. 5 to 8, with an intermediate position during clamping shown in the right half.

A flow-forming machine 10 according to the invention and FIG. 1 has a base frame 12 with a total of three vertical columns 14, which enclose a working chamber. A total of two rotationally driven spindles 20 are mounted on a plate-shaped cover area 16 so as to be movable mounted and linearly slidable by means of linear drives 22 alternately between an outer loading and unloading position and a central working position.

A clamping device 40 for picking up and holding a workpiece 5 in a suspended position is provided on the underside of each spindle 20 facing downward to the working chamber. Claw-shaped clamping elements 50 distributed along the circumference are arranged on the drum-shaped clamping device 40 for clamping the workpiece 5, which will be described in greater detail below.

On each of the vertical columns 14, radially and vertically adjustable forming rollers 30 are provided, which can also be angled in principle, wherein an outer forming roller 30*a* is rotatably mounted in each case on an outer support 34 and an inner forming roller 30*b* is rotatably mounted in each case on an inner support 38. The inner rollers 30*b* are configured to run in an inner space of the workpiece 5, and the outer rollers 30*a* are configured to process an outer circumference of the workpiece 5, as is illustrated clearly in FIG. 2. The outer rollers 30*a* and the inner rollers 30*b* are displaceable axially and radially.

According to FIG. 2, a drum-shaped workpiece 5, which is, in particular a cast or forged blank for a vehicle wheel, is clamped at and suspended from the clamping device 40. The workpiece 5 has a hub 6 with a center hole in which a centering pin 44 of the clamping device 40 engages for centering. For force-fit and form-fit holding, several claw-shaped clamping elements 50 are fed to a radially outer and upper edge of the workpiece 5 and the workpiece 5 is pressed axially against the chuck 40.

The outer forming rollers 30*a* and the inner forming rollers 30*b* are each fed to a drum-shaped circumferential portion 7 of the workpiece 5 in pairs with respect to each other and can be displaced radially and/or axially with respect to each other to set a forming gap, so that the circumferential portion 7 can be flow-formed and an individual wall thickness profile with wall thickness changes can be formed. In particular, a thickened hump and a rim flange for receiving a vehicle tire can be formed on the circumferential wall portion 7.

A structure of the clamping device 40 for a flow-forming machine 10 according to the invention is explained in greater detail below in conjunction with FIGS. 3 and 4. The drum-shaped clamping device 40 has an approximately pot-shaped housing 42, in which a first actuating device 60 is provided for axial adjustment of the claw-shaped clamping elements 50 in a vertical clamping direction. The clamping elements 50 are arranged on a lifting shaft 52, which is connected to an actuating cylinder 62 and/or a lifting plate 64 in order to move the clamping elements 50 between a lower release position and an upper clamping position.

In the clamping position, a workpiece 5 is pressed upward by the clamping elements 50 against corresponding counterholders 54, which are mounted together with the respective clamping element 50 on a plate-shaped disk 74 of a second actuating device 70. The disk 74 has external teeth, which are connected via an intermediate gear 76 to a central actuator 78, which is configured as an externally toothed gear. A rotational movement of the central actuator 78 transmits a rotational movement via the intermediate gear 76 to the respective disk 74, on which the clamping element 60 with the lifting shaft 52 is mounted eccentrically to a disk axis 72. The rotary movement thus changes a radial distance between the clamping elements 50 and the central axis of rotation, so that radial pre-positioning of the actuators 50 for adaptation to a change in diameter of the workpiece 5 can be effected in a simple manner by adjusting the adjusting wheel 78.

Around the circumference of the central actuator 78, a plurality of disks 74 each with a clamping element 50 and a counterholder 54 are arranged to clamp a workpiece 5 uniformly along the circumference.

For axial clamping, the clamping force is generated by the respective actuating cylinder 62 on the clamping element 50 and/or a lifting plate 64, which can be activated by an axial lifting mechanism not shown for uniform actuation of all clamping elements 50. A spring device 68 at the upper end of the lifting shaft 52 can be used to preload and compensate for differences in thickness. In principle, an additional axial clamping force for clamping the workpiece 5 can also be applied via the spring clamping device 68.

For concentric movement of the clamping elements 50 and the 54, a radial groove-shaped guide is provided in the guide disk 65 for each clamping element 50.

For central diameter adjustment, a central adjustment element with position detection is provided above the spindle drives 20, which is connected to the multi-spline coupling 79 via a drive shaft and can counteract corresponding adjustment and centrifugal forces of the clamping elements 50.

An alternative clamping device 40 for the flow-forming machine 10 according to the invention is shown in FIGS. 5 to 9. According to FIG. 5, the clamping device 40 has a drum-shaped base body, on the end face of which a plurality of clamping elements 50, specifically eight clamping elements 50, are arranged distributed along the circumference of the workpiece 5 for clamping a workpiece 5. Each clamping element 50 is adjustable together with an associated actuating cylinder 62 on a plate-shaped carriage 73 parallel to the central axis of rotation. The carriages 73 are mounted for radial displacement along radially oriented guide grooves in the drum-shaped base body. A central centering pin 44 is provided for centering the workpiece 5, which can be moved axially into a corresponding central opening in the workpiece 5.

For clamping the workpiece 5, the clamping elements 50 are first in a release position, shown schematically in the right half of FIG. 8. In this release position, the carriages 73 of the second actuating device are displaced radially outward. At the same time, the clamping elements 50 are displaced axially upward by the actuating cylinders 62 as shown in FIG. 8.

When all clamping elements 50 are in this release position, a workpiece 5 can be placed on and centered concentrically to the axis of rotation by means of the centering pin 44.

The carriages 73 are displaced radially inward, preferably by actuating cylinders not shown, via the second actuating device not shown in more detail until the clamping elements 50 come into radial contact with the workpiece 5. This is clearly illustrated in the right half of FIG. 9.

Starting from this pre-positioning by the second actuating device with the carriages 73, the workpiece 5 can now be firmly clamped by the clamping elements 50, wherein the state is achieved which is clearly shown in FIGS. 5 to 7. For this purpose, the clamping elements 50 are displaced downward via the actuating cylinders 62, wherein the workpiece 5 is thereby pressed against the base body of the clamping device 40 and firmly clamped. For releasing the workpiece 5, the clamping elements 50 can be displaced back in reverse order to their initial or release position according to FIG. 8.

Also in this variant of the invention, a pre-positioning of the clamping elements 50 can be effected by means of the second actuating device by means of the preferably radially and linearly displaceable carriages 73. This enables the clamping device to efficiently clamp workpieces 5 with different outer diameters.

In principle, the clamping or centering pin 44 can alternatively be configured as a jaw chuck so that it can clamp in the inner bore and/or externally on a sprue pin of the casting blank.

In principle, the clamping element 50 can alternatively be axially fed to the workpiece 5 for clamping by a pivoting movement.

The invention claimed is:

1. A flow-forming machine for flow-forming a substantially rotation-symmetric workpiece having a drum-shaped circumferential portion, comprising a spindle which can be driven in rotation about a spindle axis, a clamping device which is arranged on the spindle and has a plurality of clamping elements which are adjustable between a clamping position, in which the clamping elements abut against an outer circumferential region of the workpiece with a predetermined clamping force and hold the workpiece on the spindle for forming, and a release position, in which the clamping elements are spaced from the workpiece in a defined manner for releasing the workpiece from the spindle, by means of a first actuating device, wherein the clamping force for holding the workpiece on the spindle during forming can be applied by the first actuating device, and a plurality of forming rollers which are axially feedable to the drum-shaped circumferential portion of the workpiece and are radially and axially feedable for forming the circumferential portion of the workpiece, wherein a second actuating device is provided on the clamping device, by means of which a position of the clamping elements can be set in a radial direction for adapting to a diameter of the workpiece, and a control device is provided, by means of which the second actuating device can be actuated depending on the diameter of the workpiece to be formed, wherein the clamping elements are radially pre-positioned depending on the diameter of the workpiece.

2. The flow-forming machine according to claim 1, wherein the clamping elements are axially and/or radially adjustable between the clamping position and the release position by means of the first actuating device.

3. The flow-forming machine according to claim 1, Wherein the first actuating device comprises at least one actuating cylinder, which is hydraulically operated.

4. The flow-forming machine according to claim 3, wherein each clamping element is assigned an actuating cylinder by means of which the clamping element is displaceable in each case between the clamping position and the release position.

5. The flow-forming machine according to claim 1, wherein each clamping element is mounted on a rotatable disk eccentrically to a disk axis, wherein the disk axes are oriented parallel to the spindle axis, and the second actuating device has an actuator for rotating the disks with the clamping elements.

6. The flow-forming machine according to claim 1, wherein each clamping element is mounted on a radially displaceable or pivotable carriage, and the second actuating device is configured for radially displacing or pivoting the carriages.

7. The flow-forming machine according to claim 1, wherein the spindle axis is arranged vertically, and the clamping device is arranged suspended from the spindle, wherein a workpiece can be clamped from below.

8. The flow-forming machine according to claim 1, wherein at least one discharge opening is provided, and a suction device is provided, by means of which air and/or fumes can be suctioned-off through the at least one discharge opening.

9. The flow-forming machine according to claim 1, wherein a central centering pin is arranged on the clamping device, which pin is configured to be resilient and/or flexible.

10. The flow-forming machine according to claim 1, Wherein the control device is configured for supplying data concerning the diameter of the workpiece, and is connected to a control station and/or to at least one sensor for identifying the workpiece using the diameter of the workpiece.

11. The flow-forming machine according to claim 1, wherein for flexible forming of each individual workpiece, the control device controls a movement of the forming rollers during forming.

12. The flow-forming machine according to claim 1, wherein at least one outer forming roller and at least one inner forming roller are provided, which abut against an outer circumference or an inner circumference of the drum-shaped circumferential portion of the workpiece and which, for forming and shaping a wall thickness profile with changing wall thickness, are adjustable in the axial and radial direction relative to one another by the control device and/or a pitch angle of the at least one inner forming roller is variable.

13. The flow-forming machine according to claim 1, wherein two interchangeable spindles are provided, wherein a first interchangeable spindle is located in the working chamber, while a second interchangeable spindle is located in a loading and/or unloading position, wherein the two interchangeable spindles are displaceable alternately relative to one another.

14. The flow-forming machine according to claim 1, wherein a measuring device is arranged by means of which process-relevant dimensions or data of the workpiece can be identified prior to and/or after forming.

15. The flow-forming machine according to claim 1, wherein at least one cooling device and/or one heat-protective device are provided for semi-hot and/or hot shaping of the workpiece.

16. The flow-forming machine according to claim 1, wherein a quick-release clamping device, by means of which a semi-automatic or fully automatic roller change can be carried out, is arranged on an inner support (38) and/or an outer support on a bearing of at least one outer forming roller and/or at least one inner forming roller.

17. The flow-forming machine according to claim 1, wherein in a forming area the workpiece has a temperature differing from a clamping and centering area.

18. A method of flow-forming a substantially rotation-symmetric workpiece having a drum-shaped circumferential portion, the method comprising:

providing a flow-forming machine comprising a spindle which can be driven in rotation about a spindle axis, a clamping device which is arranged on the spindle and has a plurality of clamping elements which are adjustable between a clamping position, in which the clamping elements abut against an outer circumferential region of the workpiece with a predetermined clamping force and hold the workpiece on the spindle for forming, and a release position, in which the clamping elements are spaced from the workpiece in a defined manner for releasing the workpiece from the spindle, by means of a first actuating device, wherein the clamping force for holding the workpiece on the spindle during forming can be applied by the first actuating device, a plurality of forming rollers which are axially feedable to the drum-shaped circumferential portion of the workpiece and are radially and axially feedable for forming the circumferential portion of the workpiece, a second actuating device on the clamping device, by means of which a position of the clamping elements can be set in a radial direction for adapting to a diameter of the workpiece, and a control device, by means of which the second actuating device can be actuated depending on the diameter of the workpiece to be formed, wherein the clamping elements are radially pre-positioned depending on the diameter of the workpiece, clamping the workpiece to the spindle by means of the clamping device, driving the spindle in rotation about the spindle axis, and radially and axially feeding the plurality of forming rollers to the workpiece for forming the circumferential portion, wherein the second actuating device is configured to adapt the position of the clamping elements to the diameter of the workpiece, and the control device is configured to actuate the second actuating device depending on the diameter of the workpiece to be formed, so that the clamping elements are radially pre-positioned depending on the diameter of the workpiece.

* * * * *